US010481537B2

(12) United States Patent
Saito et al.

(10) Patent No.: US 10,481,537 B2
(45) Date of Patent: Nov. 19, 2019

(54) IMAGE FORMING APPARATUS AND CONTROL PROGRAM FOR REMOVING CARRIERS ON A PHOTORECEPTOR

(71) Applicant: Konica Minolta, Inc., Tokyo (JP)

(72) Inventors: Hiroyuki Saito, Tokyo (JP); Tetsuya Ishikawa, Sagamihara (JP); Tomohiro Kawasaki, Sagamihara (JP); Ryoei Ikari, Tokorozawa (JP); Tatsuya Furuta, Mitaka (JP); Aiko Kubota, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/868,495

(22) Filed: Jan. 11, 2018

(65) Prior Publication Data

US 2018/0217547 A1 Aug. 2, 2018

(30) Foreign Application Priority Data

Jan. 31, 2017 (JP) ..... 2017-015861

(51) Int. Cl.
*G03G 15/00* (2006.01)
*G03G 21/00* (2006.01)

(52) U.S. Cl.
CPC ..... *G03G 15/5054* (2013.01); *G03G 15/5004* (2013.01); *G03G 21/0047* (2013.01); *G03G 21/0058* (2013.01)

(58) Field of Classification Search
None
See application file for complete search history.

(56) References Cited

U.S. PATENT DOCUMENTS

2006/0182466 A1* 8/2006 Oda ..... G03G 21/0005 399/253
2009/0169279 A1* 7/2009 Okada ..... C03C 17/008 399/356
2011/0097115 A1* 4/2011 Minegishi ..... G03G 15/095 399/264

FOREIGN PATENT DOCUMENTS

JP H10-326047 A 12/1998
JP 2009037089 A 2/2009

OTHER PUBLICATIONS

English machine translation of JP H10-326047 A.*
(Continued)

*Primary Examiner* — David M. Gray
*Assistant Examiner* — Geoffrey T Evans
(74) *Attorney, Agent, or Firm* — Lucas & Mercanti, LLP

(57) ABSTRACT

An image forming apparatus that forms an image on a transfer material in an image forming mode, includes: a photoreceptor rotatable in a predetermined rotation direction; a developer that forms a toner image on the photoreceptor using a two-component developing agent including toner and a carrier; a transferor that transfers the toner image on the photoreceptor onto the transfer material; a carrier collector that applies an electric field corresponding to a collecting bias to a carrier adhering to the photoreceptor to collect the carrier; a carrier detector that detects a carrier remaining on the photoreceptor after collecting the carrier by the carrier collector; and a hardware processor that sets the collecting bias in the image forming mode on the basis of the amount of carriers detected by the carrier detector when a carrier adhesion detecting mode for forcibly causing a carrier to adhere to the photoreceptor is executed.

14 Claims, 8 Drawing Sheets

(56) References Cited

OTHER PUBLICATIONS

English machine translation of JP 2010-230941 A.*
English machine translation of JP 2007-079440 A.*
Extended European Search Report dated Mar. 2, 2018 from corresponding European Patent Application No. 18150401.0

* cited by examiner

IMAGE FORMING APPARATUS AND CONTROL PROGRAM FOR REMOVING CARRIERS ON A PHOTORECEPTOR

The entire disclosure of Japanese patent Application No. 2017-015861, filed on Jan. 31, 2017, is incorporated herein by reference in its entirety.

BACKGROUND

Technological Field

The present invention relates to an image forming apparatus and a control program.

Description of the Related Art

In recent years, performance of electrophotographic image forming apparatuses has been improved, and thus high quality image printing can be executed at a high speed. Among such electrophotographic image forming apparatuses, image forming apparatuses of a two-component developing method are known in the related art. Since the two-component developing method is excellent in terms of gradation and other points, it is widely used in electrophotographic image forming apparatuses.

In the two-component developing method, development is carried out using a developing agent containing two components of toner and carriers accommodated in a developer. Toner is charged colored fine particles and plays a role of developing by adhering to an electrostatic latent image on a photoreceptor. Meanwhile, carriers contain a magnetic material and are fine particles that play a role of carrying toner, conveying the toner to the photoreceptor as a developing roller of the developer rotates, and charging the toner. When the carriers adhere to the photoreceptor, this may cause deterioration of image quality. Therefore, the developer applies a magnetic field to the carriers and suppresses transfer of the carriers from the developer to the photoreceptor.

However, as the printing speed increases, the number of revolutions of the developing roller increases, and the centrifugal force acting on the carriers on the developing roller increases while the diameter of carrier particles decreases as the image quality of printing improves. As a result, carriers are more likely to adhere to the photoreceptor as compared with the situation in the related art.

In relation to this, for example, JP 2009-37089 A discloses a technique of removing carriers adhering to a photoreceptor. In the technique of JP 2009-37089 A, a constant direct current bias is applied to an external carrier removing member (carrier collector) which is disposed at a position opposed to the photoreceptor and incorporates a magnet, and the carriers on the photoreceptor are attracted and removed by the force of the magnetic field and the electric field.

However, according to the technique of JP 2009-37089 A, in a case where the distance between the photoreceptor and the carrier collector changes such as after replacing the photoreceptor unit, the electric field between the photoreceptor and the carrier collector changes. Thus, there is a possibility that the force for attracting carriers on the photoreceptor changes. As a result, the carriers on the photoreceptor may not be stably removed.

SUMMARY

The present invention has been devised in view of the above problems. An object of the present invention is therefore to provide an image forming apparatus and a control program capable of stably removing carriers on a photoreceptor even in a case where the distance between the photoreceptor and a carrier collector changes.

To achieve the abovementioned object, according to an aspect of the present invention, an image forming apparatus that forms an image on a transfer material in an image forming mode, reflecting one aspect of the present invention comprises: a photoreceptor rotatable in a predetermined rotation direction; a developer that is arranged on the photoreceptor and forms a toner image on the photoreceptor using a two-component developing agent including toner and a carrier; a transferor that is arranged on the photoreceptor on a downstream side in the predetermined rotation direction with respect to the developer and transfers the toner image on the photoreceptor onto the transfer material; a carrier collector that is arranged on the photoreceptor on an upstream side in the predetermined rotation direction with respect to the transferor and on a downstream side in the predetermined rotation direction with respect to the developer and applies an electric field corresponding to a collecting bias to a carrier adhering to the photoreceptor to collect the carrier by a force of the electric field, a carrier detector that is arranged on the photoreceptor on a downstream side in the predetermined rotation direction with respect to the carrier collector and detects a carrier remaining on the photoreceptor after collecting the carrier by the carrier collector; and a hardware processor that sets the collecting bias in the image forming mode on the basis of the amount of carriers detected by the carrier detector when a carrier adhesion detecting mode for forcibly causing a carrier to adhere to the photoreceptor is executed.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
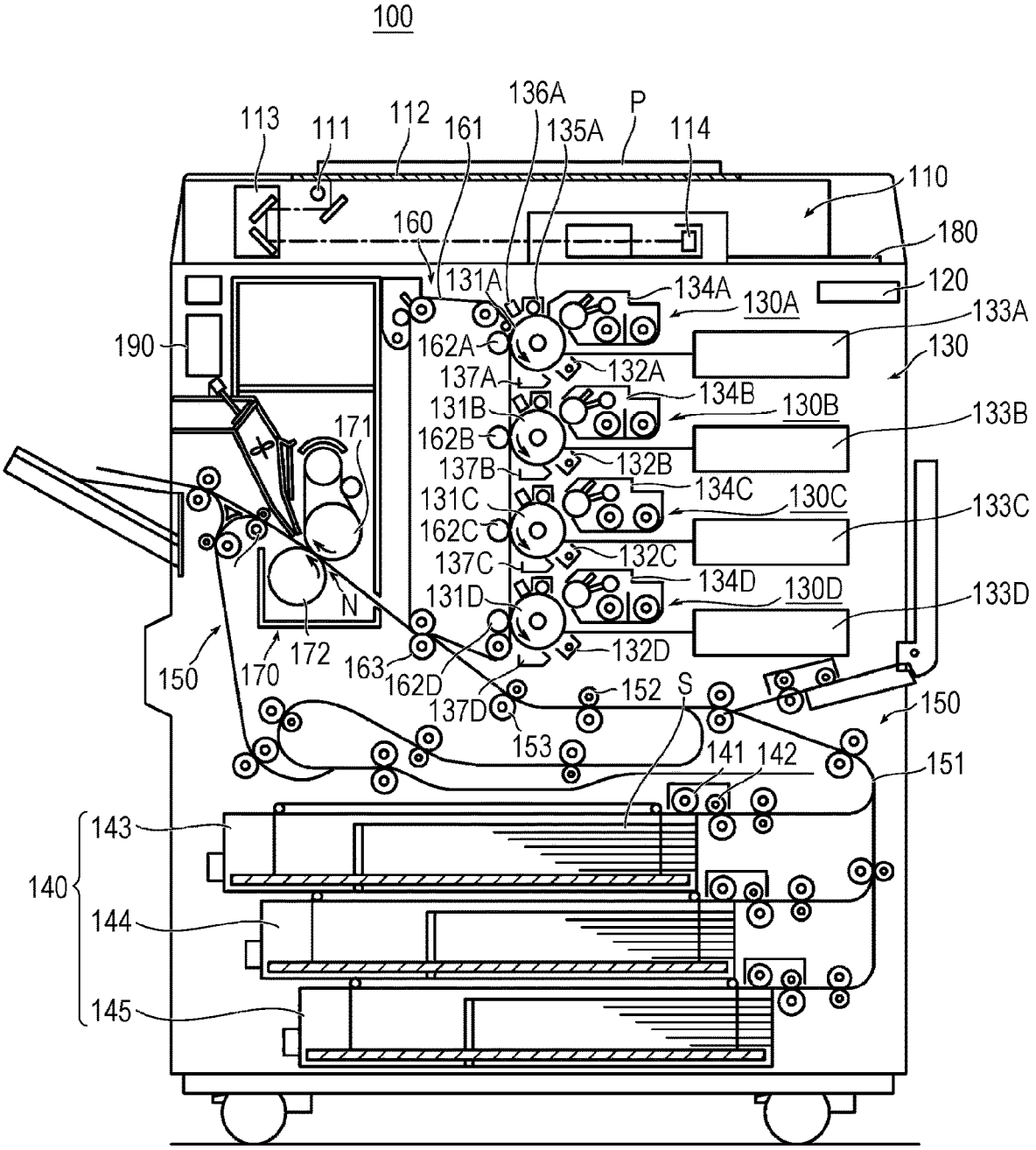
FIG. 1 is a schematic cross-sectional view illustrating an exemplary configuration of an image forming apparatus according to a first embodiment.

Hereinafter, one or more embodiments of an image forming apparatus according to the present invention will be described with reference to the drawings. However, the scope of the invention is not limited to the disclosed embodiments. Note that the same symbol is used for the same members in the drawings. Dimension ratios of the drawings are exaggerated for convenience of explanation and may be different from the actual ratios.

First Embodiment

Figure 2:
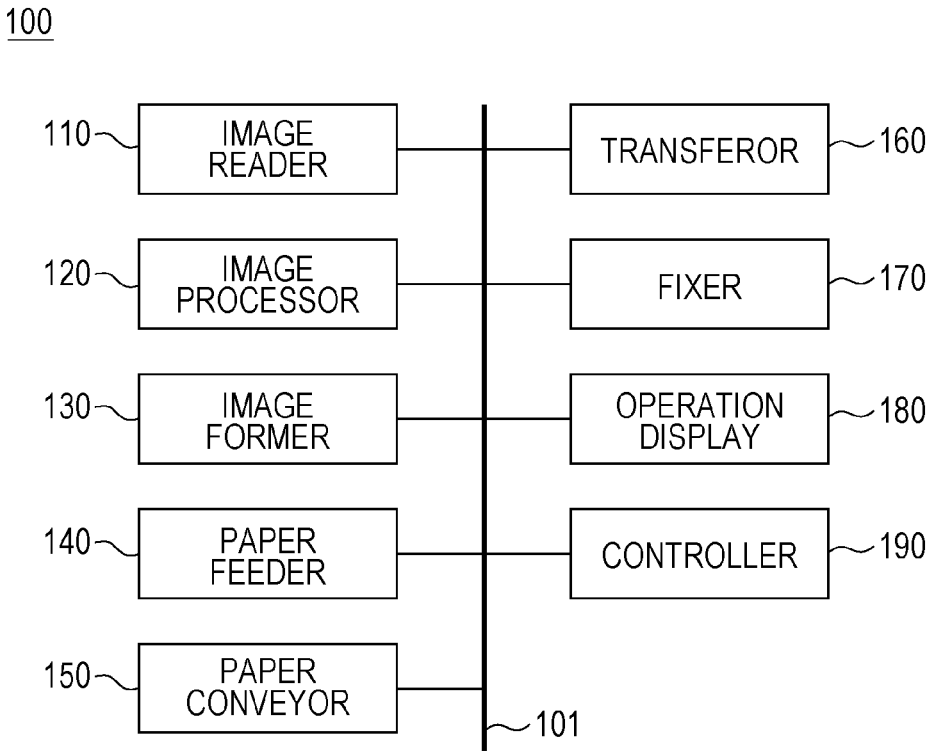
FIG. 2 is a schematic block diagram illustrating an exemplary hardware configuration of the image forming apparatus illustrated in FIG. 1.
Figure 3:
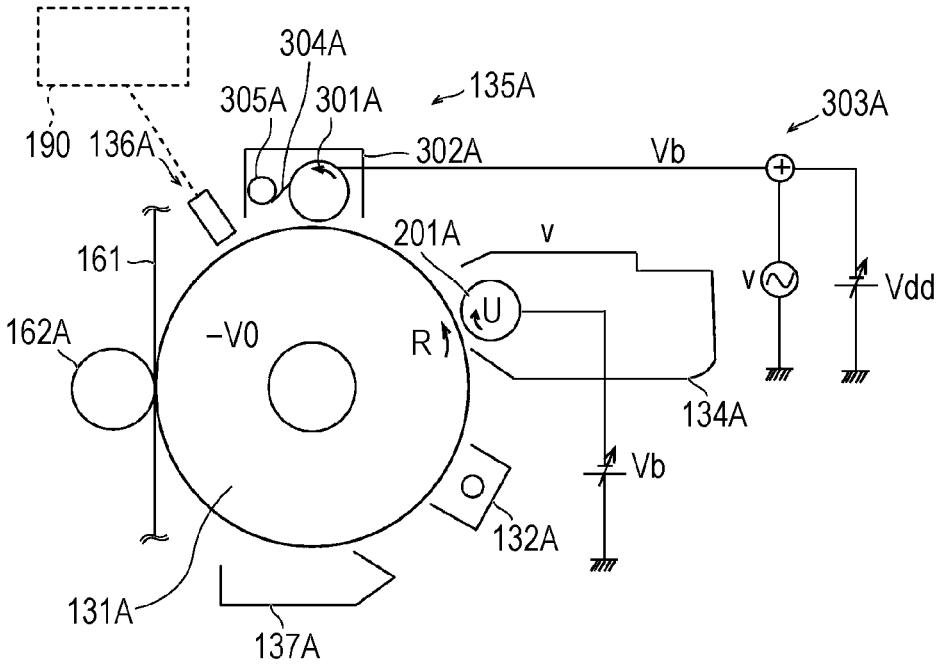
FIG. 3 is a cross-sectional view schematically illustrating an exemplary bias voltage applied to a photoreceptor, a developer, and a carrier collector.
Figure 4:
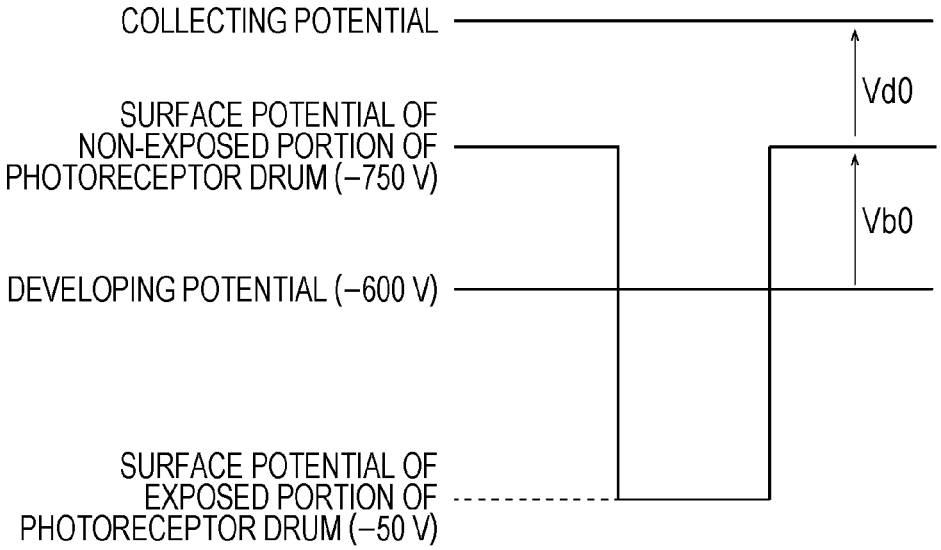
FIG. 4 is a schematic graph illustrating exemplary surface potentials of the photoreceptor, the developing roller, and a collecting roller.

FIG. 1 is a schematic cross-sectional view illustrating an exemplary configuration of an image forming apparatus according to a first embodiment, and FIG. 2 is a schematic block diagram illustrating an exemplary hardware configuration of the image forming apparatus illustrated in FIG. 1. FIG. 3 is a cross-sectional view schematically illustrating an exemplary bias voltage applied to a photoreceptor, a developer, and a carrier collector, and FIG. 4 is a schematic graph illustrating exemplary surface potentials of the photoreceptor, the developing roller, and a collecting roller.

<Image Forming Apparatus 100>

As illustrated in FIGS. 1 and 2, an image forming apparatus 100 according to the present embodiment includes an image reader 110, an image processor 120, an image former 130, a paper feeder 140, a paper conveyor 150, a transferor 160, a fixer 170, an operation display 180, and a controller 190. These components are connected by internal bus 101 so as to allow communication thereamong. The image forming apparatus 100 is an apparatus of the electrophotographic method, and may be, for example, a multifunction peripheral (MFP), a copier, a facsimile, a printer, or the like.

<Image Reader 110>

The image reader 110 reads an image of a document P and generates an image data signal. The image reader 110 includes a light source 111, a reading surface 112, an optical system 113, and an imaging element 114.

Light emitted from the light source 111 including a light emitting element such as a light emitting diode (LED) is irradiated onto the document P placed on the reading surface 112, and reflected light thereof is transmitted through the optical system 113 and forms an image on the imaging element 114 having moved to a reading position. The imaging element 114 generates an electric signal in accordance with the intensity of the reflected light from the document P. The generated electric signal is converted from an analog signal to a digital signal and then transmitted to the image processor 120 as an image data signal.

<Image Processor 120>

The image processor 120 performs various types of image processing on the image data signal received from the image reader 110 to generate print image data. In the image processor 120, for example, density correction processing, y correction processing, filter processing, image compression processing, and other processing may be performed. The generated print image data is transmitted to the image former 130.

The image processor 120 further has a rasterizer that rasterizes print data and generates print image data on the basis of print setting and the print data included in a print job received by a communicator (not illustrated). The generated print image data is transmitted to the image former 130. The communicator is an interface for communicating with a device such as a client terminal connected to a network.

<Image Former 130>

The image former 130 forms an image by the electrophotographic method. The image former 130 includes an image former 130A that forms an image of yellow (Y), an image former 130B that forms an image of magenta (M), an image former 130C that forms an image of cyan (C), and an image former 130D that forms an image of black (K).

The image former 130A includes a photoreceptor drum (photoreceptor) 131A and a charger 132A arranged in the periphery thereof, an optical writer 133A, a developer 134A, a carrier collector 135A, a carrier detector 136A, and a cleaner 137A.

As illustrated in FIG. 3, the photoreceptor drum 131A is an image carrier having a photosensitive layer made of a resin such as polycarbonate including an organic photoconductor and rotates in a rotation direction R (predetermined rotation direction) at a predetermined speed by a drum motor (not illustrated).

The charger 132A includes a corona discharger of a scorotron type arranged in the periphery of the photoreceptor drum 131A and charges the surface of the photoreceptor drum 131A by ions generated thereby. In the present embodiment, a negative charge is imparted to the surface of the photoreceptor drum 131A such that the surface potential (hereinafter referred to simply as "surface potential") of the photoreceptor drum 131A is, for example, −V0 (V).

The optical writer 133A incorporates a scanning optical device. The optical writer 133A exposes the charged photoreceptor drum 131A on the basis of input printing image data to erase the charge of the exposed portion and thereby forms a charge pattern (electrostatic latent image) corresponding to the printing image data. The potential of the exposed portion (exposed portion) of the photoreceptor drum 131A is higher than the potential (−V0) of a non-exposed portion (non-exposed portion).

The developer 134A develops the electrostatic latent image formed in the exposed portion of the photoreceptor drum 131A. As illustrated in FIG. 3, the developer 134A has a developing roller 201A configured to be rotatable in a rotation direction U opposite to the rotation direction R and is arranged in close proximity to the photoreceptor drum 131A contactlessly. A negative developing bias voltage Vb is applied to the developing roller 201A with respect to the ground. The surface potential (hereinafter referred to as "developing potential") of the developing roller 201A thus becomes −Vb (V). That is, a negative direct current bias is applied to the developing roller 201A. Hereinafter, the negative direct current bias applied to the developing roller 201A by the developing bias voltage Vb is referred to as a developing bias (−Vb) (V).

The developer 134A develops by applying toner to the electrostatic latent image formed on the photoreceptor drum 131A by using a two-component developing agent containing toner and carriers to form a toner image on the photoreceptor drum 131A.

Toner is colored fine particles charged negatively and plays a role of developing by adhering to an electrostatic latent image on the photoreceptor drum 131A. Meanwhile, carriers contain a magnetic material such as magnetic metal powder. Carries are fine particles that play a role of carrying toner, conveying the toner to the photoreceptor drum 131A as the developing roller 201A rotates, and charging the toner. As carriers, those having a volume average particle diameter of, for example, about 10 to 50 μm, preferably about 30 μm are used. In the present embodiment, carriers are positively charged by friction with toner.

As illustrated in FIG. 4, for example in a case where a surface potential of an exposed portion of the photoreceptor drum 131A is −50 (V) and a developing potential of the developing roller 201A is −600 (V), an electric field is formed directed from the exposed portion of the photoreceptor drum 131 having a high potential toward the developing roller 201A having a low potential (having a large absolute value). Therefore, toner on the developing roller 201A is attracted toward the exposed portion of the photoreceptor drum 131A having a high potential (small absolute value) from the developing roller 201A having a low potential. As a result, the toner is separated from the carriers and adheres to the exposed portion of the photoreceptor drum 131A.

Meanwhile, for example in a case where a surface potential of a non-exposed portion of the photoreceptor drum 131A is −750 (V) and a developing potential is −600 (V), an electric field is formed directed from the developing roller 201A having a high potential toward the non-exposed portion of the photoreceptor drum 131A having a low potential.

The larger a potential difference Vb0 (=V0−Vb) between the surface potential (−V0) of the non-exposed portion of the photoreceptor drum 131A and the developing potential (−Vb) is, occurrence of a phenomenon, in which toner adheres to the non-exposed portion and density becomes higher, that is, fogging can be reduced. Meanwhile, the larger the potential difference Vb0 is, the more likely the carriers tend to adhere to the photoreceptor drum 131A.

The carrier collector 135A collects (recovers) carriers adhering to the surface of the photoreceptor drum 131A. The carrier collector 135A can be arranged on the photoreceptor drum 131A on an upstream side in the rotation direction R with respect to the transferor 160 and on a downstream side in the rotation direction R with respect to the developer 134A. The carrier collector 135A includes a collecting roller 301A, a housing 302A, a power source unit 303A, a carrier peeling plate 304A, and a carrier conveyor 305A.

The collecting roller 301A is, for example, a roller having a resin magnet and a shaft. The collecting roller 301A is supported within the housing 302A rotatably in the same rotation direction R as that of the photoreceptor drum 131A and is installed in close proximity to the photoreceptor drum 131A contactlessly. An insulating layer is formed on the surface of the collecting roller 301A. The housing 302A is made of a conductive plate member and is maintained at the same potential as that of the collecting roller 301A.

The carrier collector 135A may be formed separately from the photoreceptor unit including the photoreceptor drum 131A, the charger 132, the cleaner 137A, and other components. Therefore, a user can separate the photoreceptor unit from the carrier collector 135A and replace only the photoreceptor unit. The carrier collector 135A may be configured to be detachable from the main body of the image forming apparatus 100.

It is preferable that a distance between the surface of the photoreceptor drum 131A and a surface of the collecting roller 301A facing the photoreceptor drum 131A is, for example, about 0.2 to 0.5 mm.

A tip of the carrier peeling plate 304A abuts on the collecting roller 301A and peels off adsorbed carriers. The carrier peeling plate 304A is, for example, an elastic resin film attached to a sheet metal. The collected carriers are conveyed to the carrier peeling plate 304A by rotation of the collecting roller 301A and then peeled off from the surface of the collecting roller 301A.

The carrier conveyor 305A conveys the carriers peeled off from the surface of the collecting roller 301A by the carrier peeling plate 304A to a pallet (not illustrated). The pallet accumulates the peeled carriers. The carriers accumulated in the pallet can be discharged to the outside of the image forming apparatus 100 as appropriate.

A negative direct current collecting bias voltage Vdd (V) is applied to the collecting roller 301A with respect to the ground. The surface potential (hereinafter referred to as "collecting potential") of the collecting roller 301A thus becomes −Vdd (V). That is, a negative direct current bias is applied to the collecting roller 301A. Hereinafter, the negative direct current bias applied to the collecting roller 301A by the direct current collecting bias voltage Vdd is referred to as direct current collecting bias (−Vdd) (V).

Since the direct current collecting bias (−Vdd) is set to a value lower than the surface potential (−V0), the collecting potential becomes lower than the surface potential, and an electric field is formed between the photoreceptor drum 131A and the collecting roller 301A directed from the photoreceptor drum 131A toward the collecting roller 301A. Meanwhile, as described above, between the photoreceptor drum 131A and the developing roller 201A, an electric field is formed directed from the developing roller 201A having a high potential toward the non-exposed portion of the photoreceptor drum 131A having a low potential.

Therefore, the direction of the electric field formed between the photoreceptor drum 131A and the collecting roller 301A with respect to the photoreceptor drum 131A is opposite to the direction of the electric field formed between the non-exposed portion of the photoreceptor drum 131A and the developing roller 201A with respect to the photoreceptor drum 131A.

The carriers adhering to the photoreceptor drum 131A are efficiently collected by the attraction force of the magnetic field of the resin magnet of the collecting roller 301A and the attraction force of the electric field of the direct current collecting bias (−Vdd). Note that it is also possible to include a magnet with a higher magnetic force so as to collect the carriers only by the attraction force of the magnetic field of the resin magnet; however, this is not realistic since this requires a large cost.

As illustrated in FIG. 3, it is also possible to apply a collecting bias voltage Vd obtained by superimposing the alternating current collecting bias voltage (AC component) v on the direct current collecting bias voltage (DC component) Vdd to the collecting roller 301A. When the collecting bias voltage Vd is applied to the collecting roller 301A, an electric field for oscillating the carriers is formed, thus allowing the carriers to be easily separated from the photoreceptor drum 131A. Therefore, the carriers are preferably removed from the photoreceptor drum 131A. In this manner, the carrier collector 135A applies an electric field corresponding to the collecting bias (−Vd) to the carriers adhering to the photoreceptor drum 131 to collect the carriers by the force of the electric field. On the other hand, since the collecting potential is lower than the surface potential, the negatively charged toner is not collected by the collecting roller 301A.

The amount of carriers collected by the collecting roller 301A is dependent on the magnitude of the electric field formed between the photoreceptor drum 131A and the collecting roller 301A. As the electric field expands, the carriers on the photoreceptor drum 131A can be collected by the collecting roller 301A more easily. Therefore, in order to collect a large amount of carriers, setting the collecting potential lower than the surface potential, that is, setting the direct current collecting bias (−Vdd) lower (setting the direct current collecting bias voltage Vdd higher) is considered to be effective.

Figure 5:
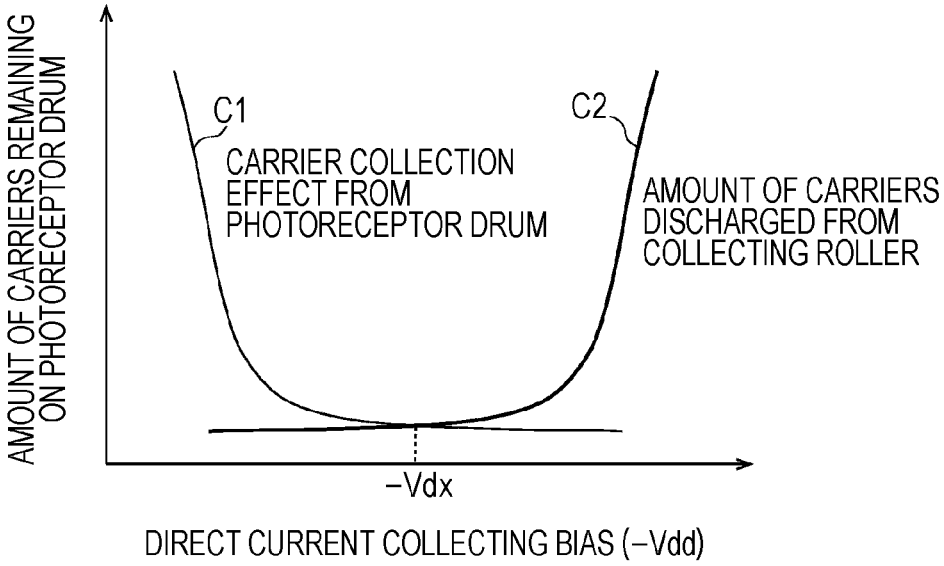
FIG. 5 is a schematic graph illustrating an exemplary relationship between a direct current collecting bias and the amount of remaining carriers on a photoreceptor drum after performing carrier collection.

With reference to FIG. 5, the relationship between the direct current collecting bias (−Vdd) and the amount of remaining carriers on the photoreceptor drum 131A after performing carrier collection will be described. FIG. 5 is a schematic graph illustrating an exemplary relationship between the direct current collecting bias (−Vdd) and the amount of remaining carriers on the photoreceptor drum 131A after performing carrier collection.

When the direct current collecting bias (−Vdd) is lowered, the electric field between the photoreceptor drum 131A and the collecting roller 301A increases, and the attraction force acting on the carriers on the photoreceptor drum 131A increases. Therefore, the amount of carriers collected from the photoreceptor drum 131A increases. Therefore, when the direct current collecting bias (−Vdd) is lowered, the amount of remaining carriers on the photoreceptor drum 131A decreases due to the carrier collection effect from the photoreceptor drum 131 by the collecting roller 301A as indicated by curve C1.

However, according to a research in recent years, when the direct current collecting bias (−Vdd) is too low, carriers collected by the collecting roller 301A are subjected to electric field separation, and the separated carriers return from the collecting roller 301A to the photoreceptor drum 131A and adhere thereto again. The amount of carriers returning from the collecting roller 301A to the photoreceptor drum 131A (the amount of carriers discharged from the collecting roller 301A) increases as the direct current collecting bias (−Vdd) decreases as indicated by curve C2.

Therefore, the amount of carriers on the photoreceptor drum 131A decreases to approximately −Vdx when the direct current collecting bias (−Vdd) is lowered. However, when the direct current collecting bias is too low as to be lower than −Vdx, the collected carriers return to the photoreceptor drum 131A and adheres thereto again, and thus the amount of carriers on the photoreceptor drum 131A turns to increase.

Figure 6:
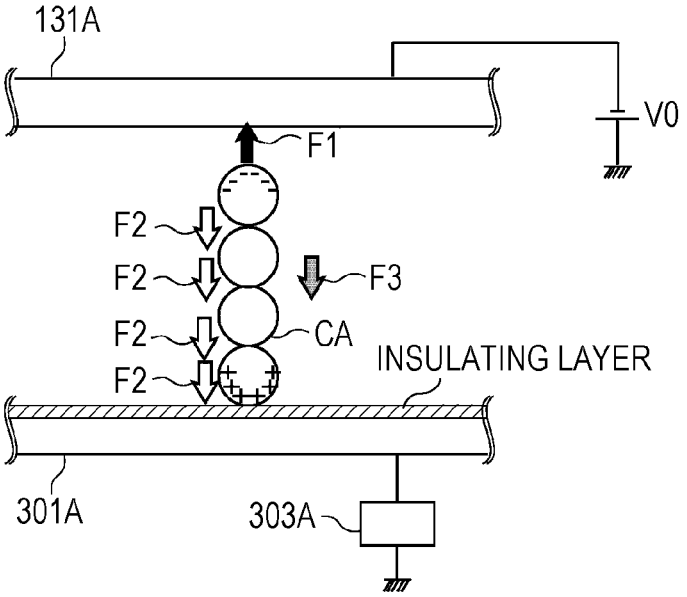
FIG. 6 is a conceptual diagram for explaining an electric field separation phenomenon of carriers collected by a collecting roller.
Figure 7:
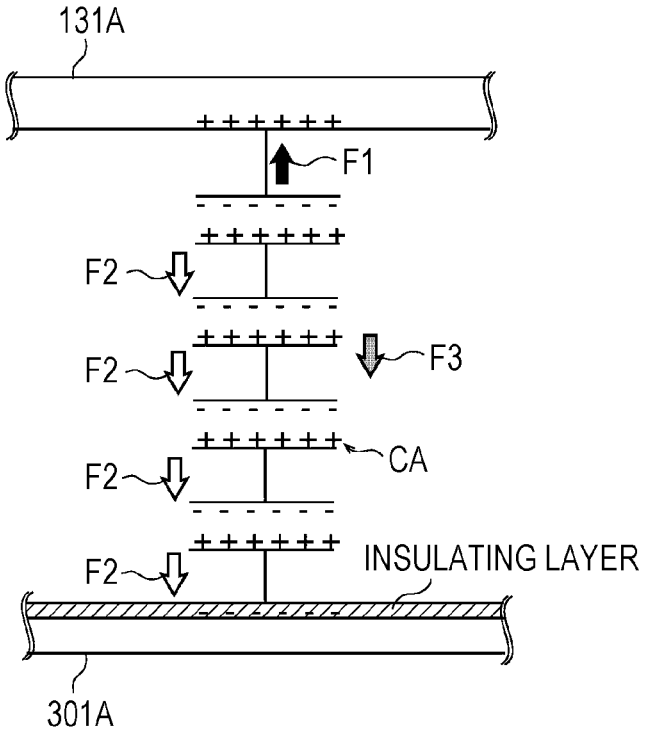
FIG. 7 is a schematic diagram illustrating exemplary polarization among the carriers illustrated in FIG. 6.

Next, with reference to FIGS. 6 and 7, a phenomenon in which carriers collected by the collecting roller 301A return to the photoreceptor drum 131A will be described. FIG. 6 is a conceptual diagram for explaining a phenomenon of electric field separation of carriers collected by the collecting roller 301A. FIG. 7 is a schematic diagram illustrating exemplary polarization among the carriers illustrated in FIG. 6.

In a region where the direct current collecting bias (−Vdd) is lower than −Vdx, a carrier chain in which carriers CA are linked in a chain form is formed from the collecting roller 301A toward the photoreceptor drum 131A is formed on the collecting roller 301A. Since the insulating layer is formed on the surface of the collecting roller 301A, the carrier chain and the power source unit 303A are insulated therebetween. Therefore, due to the electric field between the photoreceptor drum 131A and the collecting roller 301A, positive charges and negative charges are generated in each of the carriers CA by polarization.

When the electric field between the photoreceptor drum 131A and the collecting roller 301A increases, an electric field is formed in the carrier chain. Thus, negative charges are accumulated on a tip portion of the carrier chain on the photoreceptor drum 131A side, and positive charges are accumulated at a tip portion thereof on the collecting roller 301A side. Therefore, an electric field is generated between the photoreceptor drum 131A and the tip portion of the carrier chain on the photoreceptor drum 131A side, and thus an electrostatic force (F1) acts on the carrier chain. In addition to the electrostatic force (F1), an electrostatic attraction force (F2) acts between each pair of the positive charges and the negative charges generated by the polarization in the carriers CA.

When the electrostatic force (F1) exceeds the magnetic field force (F3) by the resin magnet of the collecting roller 301A, there is a possibility that the carrier chain is divided and some of the carriers are transferred onto the photoreceptor drum 131A.

In this manner, in a range where the direct current collecting bias (−Vdd) is lower than −Vdx, a carrier chain is formed on the collecting roller 301A, and a tip portion of the carrier chain on the photoreceptor drum 131A side is negatively charged. As a result, the carriers CA return to the photoreceptor drum 131A side and adheres to the surface of the photoreceptor drum 131A again. That is, in a range where the direct current collecting bias (−Vdd) is low, the ability to remove the carriers CA is low. Meanwhile, in a range where the direct current collecting bias (−Vdd) is higher than −Vdx, the force to separate the carriers CA from the photoreceptor drum 131A weak, and thus the ability to remove the carriers CA is low. In the present embodiment, an optimum value (−Vdo) of the direct current collecting bias applied to the collecting roller 301A is determined by carrier adhesion detecting processing, which will be described later, in consideration of characteristics of such carrier collection.

The carrier detector 136A detects carriers remaining on the photoreceptor drum 131A after carrier collection by the carrier collector 135A when carrier adhesion detecting processing is performed. The carrier detector 136A has, for example, a reflection type optical sensor, observes the surface of the photoreceptor drum 131A, and outputs an electric signal corresponding to the surface state (for example, carrier adhesion) of the photoreceptor drum 131A. The carrier detector 136A is arranged on the photoreceptor drum 131A on a downstream side in the rotation direction R with respect to the carrier collector 135A and on an upstream side in the rotation direction R with respect to the transferor 160. A detection result of the carrier detector 136A is transmitted to the controller 190.

The cleaner 137A scrapes (removes) residual matters such as toner, carriers, and external additives remaining on the surface of the photoreceptor drum 131A after the toner image is transferred to an intermediate transfer belt which will be described later, thereby used for maintaining a good surface condition.

In this manner, the image former 130A receives the print image data generated by the image processor 120, the optical writer 133A writes the print image data on the photoreceptor drum 131A, and an electrostatic latent image based on the print image data is formed on the photoreceptor drum 131A. Then, the electrostatic latent image is developed by the developer 134A, and a toner image which is a visible image is formed on the photoreceptor drum 131A. After the toner image is developed on the photoreceptor drum 131A, the carrier collector 135A collects carriers adhering to the photoreceptor drum 131A.

Furthermore, each of the image formers 130B, 130C, and 130D also has a photoreceptor, a charger, an optical writer, a developer, a carrier collector, a carrier detector, and a cleaner each having a similar configuration to that of the image former 130A. Images of yellow (Y), magenta (M), cyan (C), and black (K) are formed on the photoreceptor drums 131A, 131B, 131C, and 131D, respectively, of the image former 130.

Configurations of the photoreceptor, the charger, the optical writer, the developer, the carrier collector, the carrier detector, and the cleaner of the image formers 130B, 130C, and 130D are the same as those of the image former 130A, and thus detailed description thereof are omitted. Hereinafter, when a configuration common to the image formers 130A, 130B, 130C, and 130D is described, the above components are referred to as the image former 130, the photoreceptor drum 131, the charger 132, the optical writer 133, the developer 134, the carrier collector 135, a carrier detector 136, and the cleaner 137.

<Paper Feeder 140>

The paper feeder 140 accommodates papers and supplies the papers to the paper conveyor 150. The paper feeder 140 includes a feed roller 141, a separating roller 142, and paper feed trays 143, 144, and 145.

Papers S are accommodated in the paper feed tray 143, 144, or 145. For example, the papers S are fed from the paper feed tray 143 by the feed roller 141 and separated into each sheet by the separating roller 142.

<Paper Conveyor 150>

The paper conveyor 150 conveys a paper S in the image forming apparatus 100. The paper conveyor 150 includes a paper conveyance path 151 and a plurality of conveyance rollers each including a loop roller 152 and a registration roller 153.

The paper conveyor 150 conveys the paper S fed from the manual feed tray or the paper feeder 140 to the image former 130. The paper S is timing-controlled by a registration roller 153 and is conveyed to the transferor 160 in synchronization with the toner image. The paper S on which the toner image is transferred by the transferor 160 is conveyed to the fixer 170, and the toner image is fixed on the paper S.

<Transferor 160>

The transferor 160 transfers the toner image on the photoreceptor drum 131 to the paper S as a transfer material. The transferor 160 is arranged on the photoreceptor drum 131 on a downstream side in the rotation direction R with respect to the developer 134 and the carrier collector 135. The transferor 160 has an intermediate transfer belt 161, a primary transferor 162, and a secondary transferor 163.

The intermediate transfer belt 161 is wound around the primary transferor 162 and a plurality of rollers and supported so as to be able to travel. The primary transferor 162 includes primary transfer modules 162A, 162B, 162C, and 162D corresponding to yellow, magenta, cyan and black, respectively. The secondary transferor 163 is arranged outside the intermediate transfer belt 161 and is positioned such that the paper S can pass between the intermediate transfer belt 161 and the secondary transferor 163.

<Fixer 170>

The fixer 170 fixes the color toner image transferred onto the paper S. The fixer 170 includes a heating roller 171 and a pressure roller 172. When the paper S passes between the heating roller 171 and the pressure roller 172, pressure and heat are applied thereto. The toner image on the paper S melts and fixed thereon.

<Operation Display 180>

The operation display 180 includes, for example, a display and a keyboard, or a touch panel and functions as an input unit and an output unit. The keyboard has a plurality of keys such as a selection key for designating the size of a paper, numeric keys for setting the number of copies, a start key for instructing to start operation, a stop key for instructing to stop operation. The input unit is used for a user to provide various instructions such as character input, various settings, and start instruction. The output unit is used for presenting the user with the device configuration, an execution status of a print job, an occurrence status of a paper jam, an occurrence situation of an error, settings that can be currently changed, and other information.

<Controller 190>

The controller 190 has an auxiliary storage device (not illustrated), a memory, and a central processing unit (CPU). These are connected to each other via an internal bus to allow communication thereamong.

The auxiliary storage device includes a large-capacity storage device such as a hard disk drive, or a flash memory. The memory includes a random access memory (RAM) and a read only memory (ROM). In the RAM, calculation results associated with execution of the CPU and other data are stored.

In the controller 190, the CPU executes a control program. The control program is, for example, stored in the auxiliary storage device and loaded to the RAM of the memory when executed by the CPU. In accordance with the control program, the CPU controls the respective component of the image reader 110, the image processor 120, the image former 130, the paper feeder 140, the paper conveyor 150, the transferor 160, the fixer 170, and the operation display 180 in an integrated manner to implement various functions.

The controller 190 has a plurality of operation modes including an "image forming mode" and a "carrier adhesion detecting mode". The image forming mode is an operation mode for performing normal image formation, and the carrier adhesion detecting mode is an operation mode for setting (determining) a collecting bias. A collecting bias set and updated in the carrier adhesion detecting mode is used for carrier collection in the image forming mode thereafter. The image forming mode and the carrier adhesion detecting mode can be implemented by the CPU executing the control program.

In the carrier adhesion detecting mode, the controller 190 controls the developer 134 so as to forcibly adhere a predetermined amount of carriers to the photoreceptor drum 131. Furthermore, in the carrier adhesion detecting mode, the controller 190 measures the amount of carriers remaining on the photoreceptor drum 131 after collection of the carriers by the carrier collector 135 and updates the collecting bias on the basis of the amount of the carriers.

In the carrier adhesion detecting mode, when carriers on the photoreceptor drum 131 are collected by the carrier collector 135, a direct current collecting bias for carrier adhesion detection (hereinafter referred to as "detection collecting bias") is applied to the collecting roller 301.

In the carrier adhesion detecting mode, the controller 190 measures the amount of the carriers remaining on the photoreceptor drum 131 when the collecting bias is set to a different value and updates the collecting bias on the basis of the relationship between the collecting bias and the amount of carriers remaining on the photoreceptor.

<Carrier Adhesion Detecting Processing>

Figure 8:
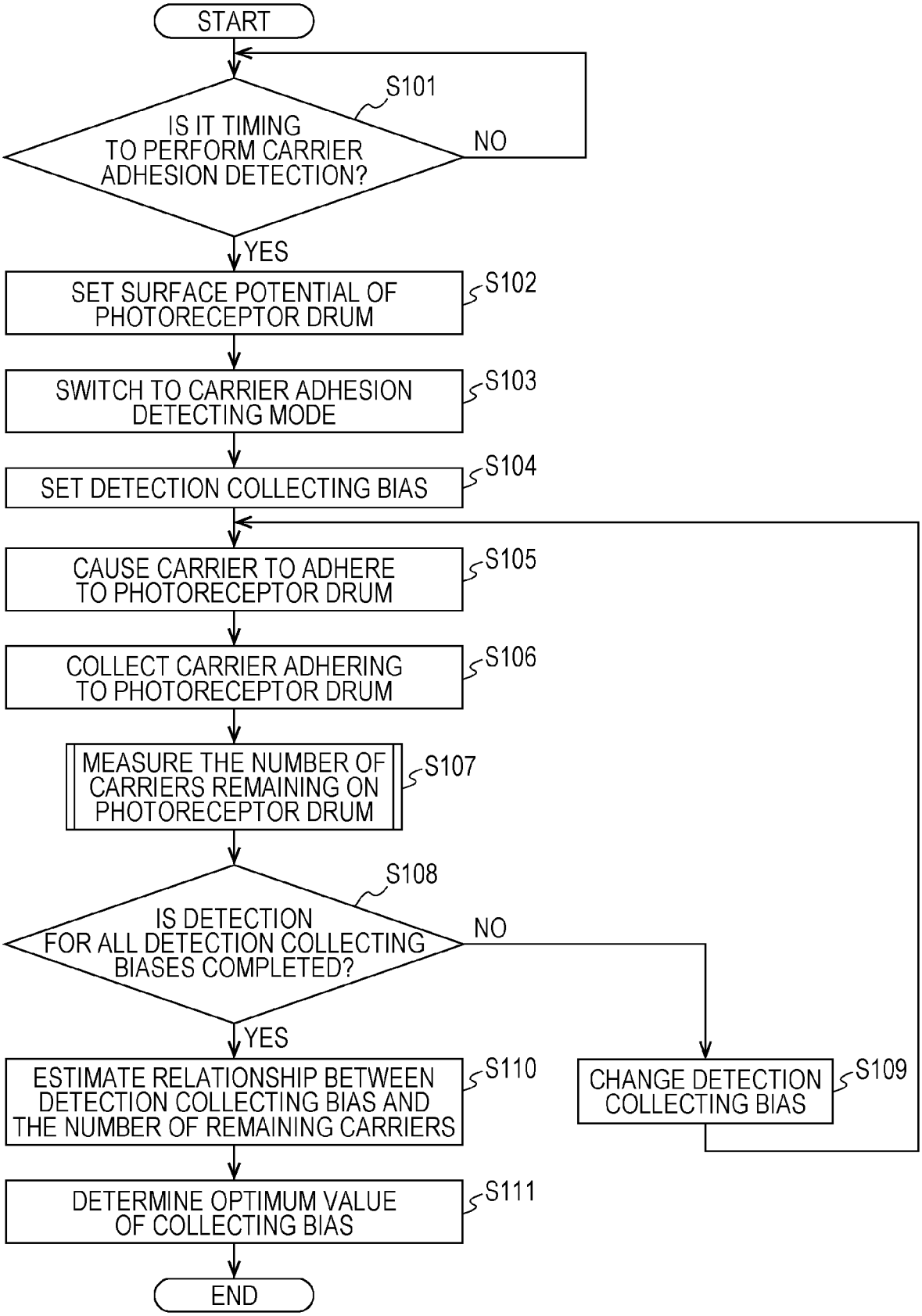
FIG. 8 is a flowchart illustrating exemplary carrier adhesion detecting processing of the first embodiment.
Figure 9:
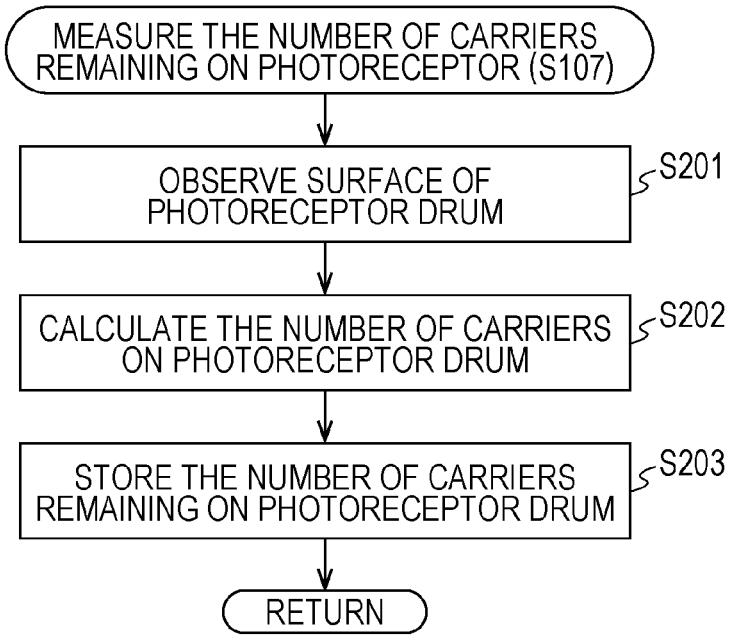
FIG. 9 is a flowchart of a subroutine illustrating exemplary processing of step S107 illustrated in FIG. 8.

Hereinafter, with reference to FIGS. 8 to 11, a specific method of updating the collecting bias by the carrier adhesion detecting processing will be described. FIG. 8 is a flowchart illustrating exemplary carrier adhesion detecting processing of the present embodiment. FIG. 9 is a flowchart of a subroutine illustrating exemplary processing of step S107 illustrated in FIG. 8. The processing illustrated in the flowchart of FIG. 8 and the subroutine flowchart of FIG. 9 is implemented by the CPU of the controller 190 executing the control program.

Figure 10A:
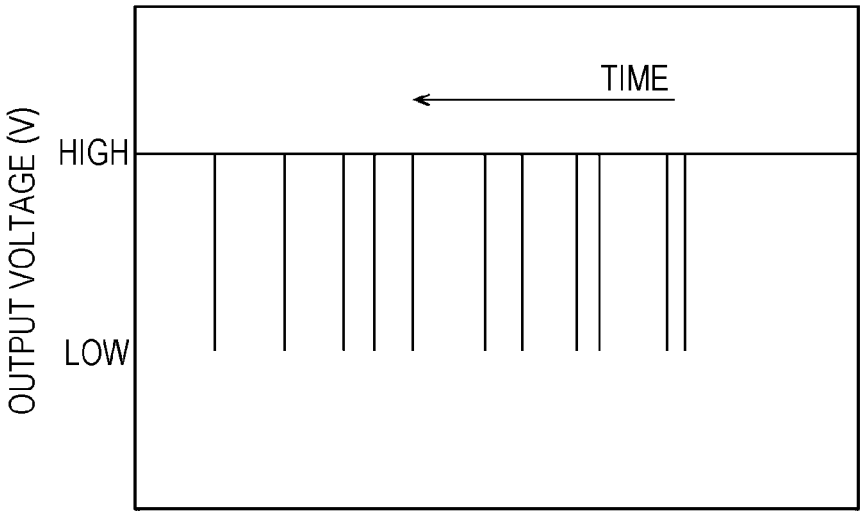
FIG. 10A is a schematic graph illustrating an exemplary output signal waveform of a carrier detector.
Figure 10B:
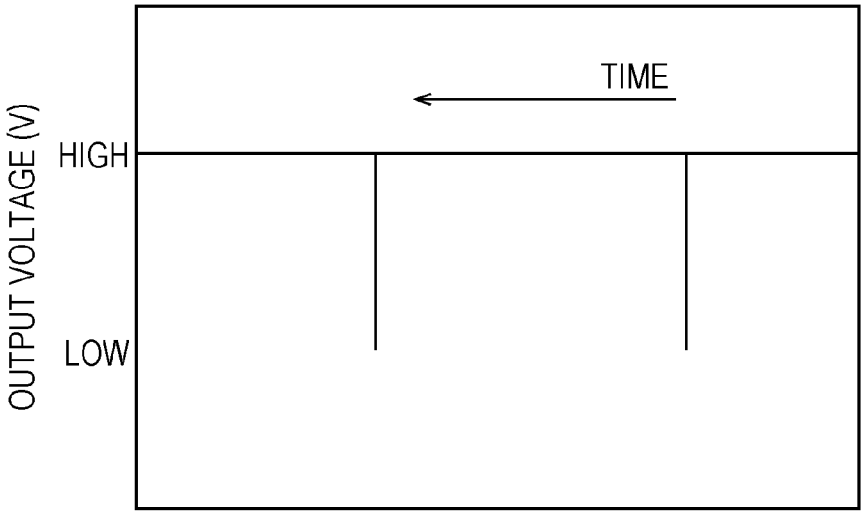
FIG. 10B is a schematic graph illustrating an exemplary output signal waveform of the carrier detector.
Figure 11:
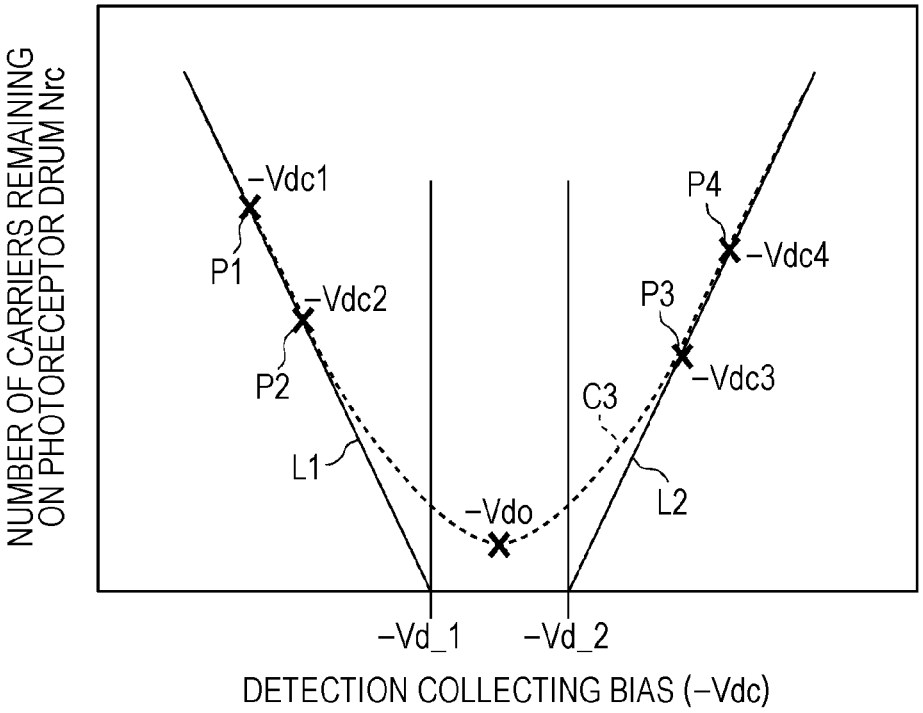
FIG. 11 is a graph illustrating an exemplary relationship between a detection collecting bias and the number of remaining carriers.

FIGS. 10A and 10B are schematic graphs each illustrating an exemplary output signal waveform of the carrier detector 136. The horizontal axis represents time while the vertical axis represents the output voltage of the carrier detector 136. FIG. 11 is a graph illustrating an exemplary relationship between the detection collecting bias (−Vdc) and the number of remaining carriers Nrc.

As illustrated in FIG. 8, first, it is determined whether it is timing to perform the carrier adhesion detection (step S101). The timing to perform the carrier adhesion detection may be immediately after replacing the two-component developing agent of the developer 134 (at the time of replacing the two-component developing agent) for example by replacing the developer 134 with a new one, immediately after replacing a photoreceptor unit (at the time of replacing the photoreceptor unit), or immediately after executing an image stabilizing mode (at the time of executing the image stabilizing mode).

In the manufacturing process of carriers, a produced carrier coarse powder may not be completely removed, and a new two-component developing agent may contain a carrier coarse powder more or less. Such a carrier coarse powder can be removed by performing the carrier adhesion detecting processing immediately after replacing the two-component developing agent of the developer 134.

Furthermore, when the photosensitive unit including the photoreceptor drum 131 is replaced, the distance between the photoreceptor drum 131 and the collecting roller 301 may change. When the distance between the photoreceptor drum 131 and the collecting roller 301 changes, there is a possibility that carriers cannot be stably collected since the force of the electric field and the magnetic field acting on the carriers adhering to the photoreceptor drum 131 change. By performing the carrier adhesion detecting processing immediately after replacing the photoreceptor drum 131, the collecting bias applied to the carrier collector 135 is updated to the optimum value. Therefore, a substantially constant force of an electric field and a magnetic field acts on the carriers on the photoreceptor drum 131 in the image forming mode, and thus the carriers can be collected stably.

In the image stabilizing mode, a toner image having a predetermined print pattern is formed on the surface of the photoreceptor drum 131, the density of the toner image after transfer to the intermediate transfer belt 161 is measured by a sensor, and control variables of the charger 132 or the developer 134 are corrected on the basis of the measurement result of the density. Since there is a possibility of changing the surface potential of the photoreceptor drum 131 in the image stabilizing mode, it is preferable to execute the carrier adhesion detecting processing immediately after performing the image stabilizing mode (at the time of executing of the image stabilizing mode).

Next, the surface potential of the photoreceptor drum 131 is set (step S102). The controller 190 acquires a setting value in the image forming mode and sets the surface potential of the photoreceptor drum 131 by, for example, adjusting the voltage applied a the grid wire of the charger 132 on the basis of the setting value (surface potential −V0).

Next, the mode is switched to the carrier adhesion detecting mode (step S103). The controller 190 switches the operation mode from the image forming mode to the carrier adhesion detecting mode, for example.

Next, a detection collecting bias (−Vdc) is set (step S104). In the present embodiment, the detection collecting bias (−Vdc) can be selected from a plurality of biases around a predetermined reference bias (−Vs). The detection collecting bias (−Vdc) is selected from a plurality of biases which has different magnitudes from each other and has a voltage higher than that of the reference bias (−Vs) and a plurality of biases which has different magnitudes from each other and has a voltage lower than that of the reference bias (−Vs).

For example, the detection collecting bias (−Vdc) is selected from first to fourth detection collecting biases (−Vdc1) to (−Vdc4) that satisfy (−Vdc1)>(−Vdc2)>(−Vs)>(−Vdc3)>(−Vdc4). As an example, (−Vdc1) to (−Vdc4) can be set as follows.

(−Vdc1):(−Vs)+200 (V)
(−Vdc2):(−Vs)+100 (V)
(−Vdc3):(−Vs)−100 (V)
(−Vdc4):(−Vs)−200 (V)

For example, when the reference bias (−Vs) is −1000 (V), (−Vdc1) is −800 (V), (−Vdc2) is −900 (V), (−Vdc3) is −1100 (V), and (−Vdc4) is −1200 (V).

Note that the reference bias (−Vs) is a bias (default) that serves as a reference for carrier collection. As the reference bias (−Vs), for example, a direct current collecting bias normally used in a carrier collector of a conventional image forming apparatus, a direct current collecting bias determined by previous carrier adhesion detecting processing, or other biases may be used.

The values of the reference bias (−Vs) and the first to fourth detection collecting biases (−Vdc1) to (−Vdc4) are stored in the memory of the controller 190 in advance, and this may be configured to allow a user to rewrite as necessary.

The controller 190 first, for example, sets the first direct current collecting bias (−Vdc1) as the detection collecting bias (−Vdc).

Next, carriers are caused to adhere to the photoreceptor drum 131 (step S105). The controller 190 adjusts the developing bias voltage Vb to be applied to the developing roller 201 in order to cause a predetermined amount of carriers to adhere from the developer 134 to the photoreceptor drum 131. More specifically, by setting the developing bias voltage Vb smaller than a value set in the image forming mode, the controller 190 sets a large difference (V0−Vb) between the surface potential (−V0) and the developing potential. As a result, the amount of carriers moving from the developer 134 to the photoreceptor drum 131 increases, and more carriers adhere to the photoreceptor drum 131 than in the image forming mode.

Next, the carriers adhering to the photoreceptor drum 131 are collected (step S106). The controller 190 applies the set first direct current collecting bias (−Vdc1) to the collecting roller 301 to control the carrier collector 135 to collect the carriers adhering to the photoreceptor drum 131.

Next, the number of remaining carriers on the photoreceptor drum 131 is measured (step S107). As illustrated in FIG. 9, the surface of the photoreceptor drum 131 is observed (step S201). The carrier detector 136 observes the surface of the photoreceptor drum 131 and outputs an electric signal corresponding to whether there are carriers adhering to the surface of the photoreceptor drum 131.

For example, the carrier detector 136 outputs a voltage of low level when carriers are adhering to the surface of the photoreceptor drum 131 and outputs a voltage of high level when no carriers are adhering. Since a carrier is a fine particle, a period of time during which the carrier detector 136 outputs a low level voltage is very short. Therefore, in an output signal waveform (hereinafter referred to as "observation waveform") of the carrier detector 136, a low period corresponding to carriers has a pulse waveform of a noise shape.

As illustrated in FIG. 10A, in a case where there are many carriers adhering to the surface of the photoreceptor drum 131, the number of times of switching between the high level and the low level increases in the observation waveform. On the other hand, as illustrated in FIG. 10B, in a case where there are a small number of carriers adhering to the surface of the photoreceptor drum 131, the number of times of switching between the high level and the low level decreases in the observation waveform.

Next, the number of carriers on the photoreceptor drum 131 is calculated (step S202). The controller 190 measures the number of times the output voltage of the carrier detector 136 switches from the high level to the low level or the number of times of switching from the low level to the high level in the observation waveform to acquire the number of carriers (carrier amount) remaining on the photoreceptor drum 131.

Next, the number of carriers remaining on the photoreceptor drum 131 is stored (step S203). The controller 190 stores the acquired number of remaining carriers in the memory in association with the detection collecting bias voltage Vdc and returns to the processing of the flowchart of FIG. 5 (return).

Next, it is determined whether the detection has been completed for all the detection collecting biases (−Vdc) (step S108). In a case where the detection collecting bias (−Vdc) is selected from the first to the fourth detection collecting biases (−Vdc1) to (−Vdc4), it is determined whether the carrier adhesion detecting processing has been completed for all the detection collecting biases (−Vdc1) to (−Vdc4). If the detection has not been completed for all the detection collecting biases (−Vdc) (step S108: NO), the detection collecting bias (−Vdc) is changed (step S109). The controller 190 selects one of the first to the fourth detection collecting bias voltages (−Vdc1) to (−Vdc4) for which the carrier adhesion detection has not been completed and sets the detection collecting bias as the detection collecting bias voltage Vdc. Then, the controller 190 proceeds to the processing of step S105.

On the other hand, if the detection has been completed for all the detection collecting biases (−Vdc) (step S108: YES), the relationship between the detection collecting bias (−Vdc) and the number of remaining carriers is estimated (step S110).

On the basis of data of the number of remaining carriers corresponding to each of the first to the fourth detection collecting biases (−Vdc1) to (−Vdc4) stored in the memory, the controller 190 estimates the relationship between the detection collecting bias (−Vdc) and the number of remaining carriers.

As illustrated in FIG. 11, the controller 190 plots the above data on an X-Y plane with an X axis representing the detection collecting bias (−Vdc) and a Y axis representing the number of remaining carriers Nrc on the photoreceptor drum 131. Plotted points P1, P2, P3, and P4 correspond to the first to the fourth detection collecting biases (−Vdc1) to (−Vdc4), respectively.

From the relationship between the direct current collecting bias (−Vdd) described with reference to FIG. 5 and the amount of remaining carriers on the photoreceptor drum, quadratic equation C3 is assumed as an approximate equation passing through the points P1, P2, P3, and P4. The detection collecting bias (−Vdc) corresponding to the minimum value of the quadratic equation C3, that is, the minimum value of the number of remaining carriers Nrc is considered to be the optimum value (−Vdo) of the direct current collecting bias.

Next, the optimum value of the collecting bias voltage is determined (step S111). If the curves C1 and C2 in FIG. 5 can be approximated by a linear line, the optimum value (−Vdo) of the direct current collecting bias can be easily calculated by the following procedures (A) to (C).

(A) A linear line L1 passing through the points P1 and P2 on the X-Y plane and a linear line L2 passing through the points P3 and P4 are calculated.

(B) An X coordinate (−Vd_1) at an intersection of the linear line L1 and the X axis and an X coordinate (−Vd_2) at an intersection of the linear line L2 and the X axis are calculated. The range from −Vd_1 to (−Vd_2) is a range of direct current collecting bias with which the number of remaining carriers is calculated to be zero with −Vd_1 as a lower limit and (−Vd_2) as an upper limit.

An average value of (C)−Vd_1 and (−Vd_2), that is, (−Vd_1+(−Vd_2))/2 is calculated to obtain the optimum value (−Vdo) of the direct current collecting bias.

Note that respective coefficients of the quadratic equation C3 passing through the points P1, P2, P3, and P4 may be calculated to calculate a direct current collecting bias corresponding to the minimum value of the quadratic equation C3, which may be used as the optimum value Vdo of the direct current collecting bias.

The controller 190 updates the collecting bias applied to the carrier collector 135 in the image forming mode to the calculated optimum value (−Vdo) of direct current collecting bias.

The image forming apparatus 100 of the present embodiment described above has the following effects.

Since the collecting bias applied to the carrier collector 135 is set to the optimum value (−Vdo), carriers adhering to the photoreceptor drum 131 can be stably removed from the photoreceptor drum 131. Therefore, damaging and cleaning failure of the photoreceptor drum 131 can be prevented or suppressed, and thus reliability of the image forming apparatus 100 can be improved. As a result, printing with high image quality and high productivity can be implemented without image defects.

Second Embodiment

In the first embodiment, the case where the number of carriers remaining on the photoreceptor drum is directly measured has been described. In the second embodiment, a case where carriers remaining on the photoreceptor drum are transferred onto an adhesive roller, and the number of carriers on the roller is measured will be described. Note that detailed descriptions on the same configuration as that of the first embodiment will be omitted in order to avoid redundant descriptions.

Figure 12:
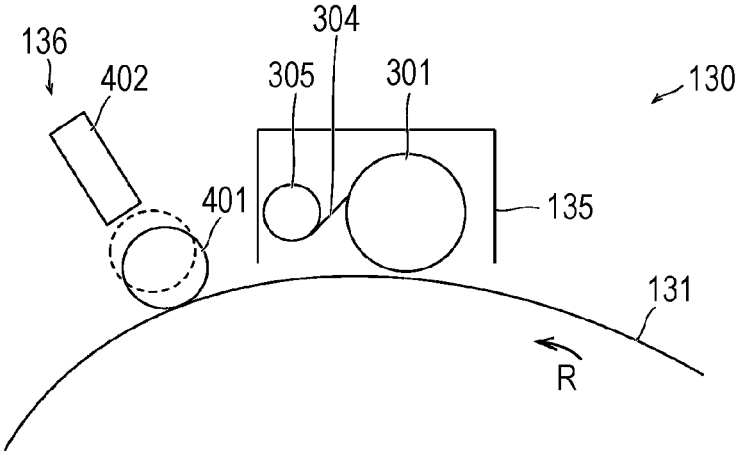
FIG. 12 is an enlarged cross-sectional view of a part of a configuration of an image former of a second embodiment.

FIG. 12 is an enlarged cross-sectional view of a part of a configuration of an image former 130 of the second embodiment. As illustrated in FIG. 12, a carrier detector 136 detects carriers remaining on a photoreceptor drum 131 after carrier collection by a carrier collector 135 when carrier adhesion detecting processing is performed.

The carrier detector 136 has an adhesive roller 401 and a detection sensor 402. The carrier detector 136 is arranged on a downstream side in a rotation direction R with respect to the carrier collector 135. The detection result of the carrier detector 136 is transmitted to a controller 190.

The adhesive roller 401 absorbs carriers on the photoreceptor drum 131. In the carrier adhesion detecting mode, the adhesive roller 401 is moved toward the photoreceptor drum 131 by a moving mechanism (not illustrated) to abut against the photoreceptor drum 131 and rotates in accordance with the rotation of the photoreceptor drum 131 (following rotation). The surface of the adhesive roller 401 is formed of a weakly adhesive member and absorbs carriers on the photoreceptor drum 131.

On the other hand, after the carrier adhesion detecting mode ends, the adhesive roller 401 is moved in a direction opposite to the photoreceptor drum 131 by the moving mechanism and is separated from the photoreceptor drum 131. Furthermore, the adhesive roller 401 is separated from the photoreceptor drum 131 in the image forming mode. The surface of the adhesive roller 401 is cleaned by maintenance at the timing of performing the carrier adhesion detection, and carriers on the adhesive roller 401 are thereby removed.

The detection sensor 402 detects carriers on the adhesive roller 401. The detection sensor 402 includes, for example, a reflection type optical sensor, observes the surface of the adhesive roller 401, and outputs an electric signal corresponding to the surface state (adhesion of carriers) of the adhesive roller 401.

In this manner, since the carriers remaining on the photoreceptor drum 131 are transferred onto the adhesive roller 401, and the number of carriers on the adhesive roller 401 is measured, conveyance of the carriers to the transferor 160 or the cleaner 137 can be prevented.

In the present embodiment, one condition related to the collecting bias (−Vd) is selected, and the value of the condition is varied, and the carrier adhesion detecting processing is thereby executed. Conditions of the collecting bias (−Vd) include, for example, a direct current collecting bias voltage Vdd, a Vpp (peak to peak) value of an alternating current collecting bias voltage v, and a duty ratio.

The controller 190 measures the cumulative number of carriers adhering to the adhesive roller 401 in a cumulative manner when a value of a condition related to the collecting bias (−Vd) is continuously varied. Then a collecting bias, with which the amount of change in the cumulative number of carriers before and after varying the value of the condition is the minimum, is set as an optimum value (−Vdo) of the collecting bias.

For example, with respect to four different conditions (condition 1 to condition 4), the carrier adhesion detecting processing is executed successively in the order of condition 1, condition 2, condition 3, and condition 4. The adhesive roller 401 is not cleaned until execution of the carrier adhesion detecting processing is completed for all the conditions 1 to 4. Therefore, after the carrier adhesion detecting processing is executed for a certain condition, a cumulative value of the number of remaining carriers having been measured under conditions having been executed by that time is measured. The controller 190 stores the cumulative value of the number of remaining carriers (carrier amount) measured for each of the condition values in the memory.

The following Table 1 exemplifies measurement results when the value of the direct current collecting bias voltage Vdd as a condition is varied.

TABLE 1

| Data No. | Value of Condition | Cumulative Value | Number of Remaining Carriers for each Condition |
|---|---|---|---|
| 1 | Value 1 | 30 | Cumulative Value of Value 1 = 30 |
| 2 | Value 2 | 45 | Cumulative Value of Value 2 − Cumulative Value of Value 1 = 15 |
| 3 | Value 3 | 57 | Cumulative Value of Value 3 − Cumulative Value of Value 2 = 12 |
| 4 | Value 4 | 87 | Cumulative Value of Value 4 − Cumulative Value of Value 3 = 30 |

On the basis of data No. 1 to data No. 4, the controller 190 calculates the optimum value (−Vdo) of the direct current collecting bias corresponding to the minimum value of the number of remaining carriers. Note that the method of calculating the optimum value (−Vdo) of the direct current collecting bias is the same as that of the first embodiment, and thus descriptions thereon will be omitted.

EXAMPLE

With respect to the configurations of the first embodiment and the second embodiment, a predetermined printing durability evaluation test (1000 kp/A3) was carried out under the following test conditions. In the course of the test, a two-component developing agent was replaced twice, and a photoreceptor unit was replaced three times.

<Test Conditions>

Photoreceptor drum: diameter φ100, linear speed 600 mm/sec, surface potential −500 V Collecting roller: diameter φ25, linear speed 162 mm/sec, rotation direction opposite to that of the photoreceptor drum Collecting bias voltage Vd: reference bias voltage Vs DC −900 V, AC Vpp 1000 V, 4 kHz, duty ratio 60%

COMPARATIVE EXAMPLE

The carrier adhesion detecting processing was not performed. The collecting bias voltage was set to a fixed value.

<Test Result>

TABLE 2

| | Black Spots on Photoreceptor Drum | Streaks due to Scratches on Photoreceptor Drum | Cleaning Failure |
|---|---|---|---|
| First Embodiment | ○ | ○ | ○ |
| Second Embodiment | ○ | ○ | ○ |
| Comparative Example | x | x | x |

As illustrated in the above table 2, black spots on the photoreceptor drum 131, streaks due to scratches on the photoreceptor drum 131, and cleaning failures did not occur in the configurations of the first embodiment and the second embodiment. On the other hand, black dots on the photoreceptor drum, streaks due to scratches on the photoreceptor drum, and cleaning failure occurred in the comparative example.

As described above, in the embodiment, the image forming apparatus and the control program have been described. However, it is understood without mentioning that those skilled in the art can add, modify, and omit an embodiment of the present invention as appropriate within the scope of the technical idea thereof.

For example, in the first and the second embodiments, the case where the toner and the carriers are negatively and positively charged, respectively. However, an embodiment of the present invention is not limited to such a case. An embodiment of the present invention can also be applied to a case where the toner and the carriers are positively and negatively charged, respectively.

Furthermore, in the first and second embodiments descriptions have been made on that a predetermined amount of carriers is caused to adhere to the photoreceptor drum from the developer in the carrier adhesion detecting mode. However, the image forming apparatus may separately include a configuration for causing a predetermined amount of carriers to adhere to the photoreceptor drum.

Meanwhile, the control program of the image forming apparatus may be provided by a computer readable recording medium such as a USB memory, a flexible disk, and a CD-ROM. Alternatively, the control program of the image forming apparatus may be provided online via a network such as the Internet. In this case, the program recorded in the computer-readable recording medium is usually transferred to and stored in a memory, a storage, or the like. This program may be provided as an independent application software or may be incorporated into software of each device as one function of the image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that forms an image on a transfer material in an image forming mode, the image forming apparatus comprising:

a photoreceptor rotatable in a predetermined rotation direction;

a developer that is arranged on the photoreceptor and forms a toner image on the photoreceptor using a two-component developing agent including toner and a carrier;

a transferor that is arranged on the photoreceptor on a downstream side in the predetermined rotation direction with respect to the developer and transfers the toner image on the photoreceptor onto the transfer material;

a carrier collector that is arranged on the photoreceptor on an upstream side in the predetermined rotation direction with respect to the transferor and on a downstream side in the predetermined rotation direction with respect to the developer and applies an electric field corresponding to a collecting bias to a carrier adhering to the photoreceptor to collect the carrier by a force of the electric field;

a carrier detector that is arranged on the photoreceptor on a downstream side in the predetermined rotation direction with respect to the carrier collector and detects a carrier remaining on the photoreceptor after collecting the carrier by the carrier collector; and a hardware processor that sets the collecting bias in the image forming mode on the basis of the amount of carriers detected by the carrier detector when a carrier adhesion detecting mode for forcibly causing a carrier to adhere to the photoreceptor is executed, wherein the hardware processor sets a developing bias voltage of the developer in the carrier adhesion detecting mode to a different value than in the image forming mode.

2. The image forming apparatus according to claim 1, wherein, in the carrier adhesion detecting mode, the hardware processor measures the amount of carriers remaining on the photoreceptor when the collecting bias is set to each of a plurality of different values and sets the collecting bias in the image forming mode on the basis of a relationship between the collecting bias and the amount of carriers remaining on the photoreceptor for each of the different values of the collecting bias.

3. The image forming apparatus according to claim 2, wherein the hardware processor measures the amount of carriers remaining on the photoreceptor in each of cases where, around a predetermined reference bias serving as a reference for carrier collection, a direct current component of the collecting bias is set to a first and a second collecting biases which have a voltage higher than that of the predetermined reference bias and have different magnitudes from each other and at a third and a fourth collecting biases which have a voltage lower than that of the reference bias and have different magnitudes from each other, and the hardware processor sets, as the collecting bias in the image forming mode, a collecting bias with which the amount of carriers remaining on the photoreceptor becomes the smallest on the basis of a relationship between the first to the fourth collecting biases and the amount of carriers remaining on the photoreceptor.

4. The image forming apparatus according to claim 1, wherein, in the carrier adhesion detecting mode, the hardware processor measures the amount of carriers remaining on the photoreceptor when a value of a condition related to the collecting bias is varied, and a collecting bias with which the amount of carriers remaining on the photoreceptor becomes the smallest is set to the collecting bias in the image forming mode.

5. The image forming apparatus according to claim 4, wherein the carrier detector comprises: an adhesive roller that abuts against the photoreceptor during execution of the carrier adhesion mode and rotates in accordance with the rotation of the photoreceptor to adsorb the carrier on the photoreceptor; and a detection sensor that detects the carrier adhering to the adhesive roller, the hardware processor measures a cumulative amount of carriers adhering to the adhesive roller in a cumulative manner when a value of a condition related to the collecting bias is continuously varied, and the hardware processor sets, as the collecting bias, a collecting bias with which the amount of change in the cumulative amount of carriers before and after varying the value of the condition is the minimum.

6. The image forming apparatus according to claim 1, wherein the hardware processor executes the carrier adhesion detecting mode at the time of replacing the photoreceptor, at the time of replacing the two-component developing agent, or at the time of executing the image stabilizing mode.

7. The image forming apparatus according to claim 1, wherein the developer has a developing roller that is arranged opposite to the photoreceptor and conveys the toner and the carrier, the carrier collector has a collecting roller that is arranged opposite to the photoreceptor and absorbs the carrier on the photoreceptor by a force of the electric field, and a direction of the electric field with respect to the photoreceptor is a direction opposite to a direction of an electric field, with respect to the photoreceptor, formed between the photoreceptor and the developing roller by a developing bias applied to the developing roller.

8. The image forming apparatus according to claim 1, wherein the collecting bias includes a direct current component and an alternating current component.

9. A non-transitory recording medium storing a computer readable control program for controlling an image forming apparatus comprising:

a photoreceptor rotatable in a predetermined rotation direction;

a developer that forms a toner image on the photoreceptor using a two-component developing agent including toner and a carrier; and a hardware processor that executes an image forming mode which is an operation mode of performing normal image formation and a carrier adhesion detecting mode which is an operation mode of setting a collecting bias, the control program causing a computer to perform:

switching the operation mode to the carrier adhesion mode;

causing a carrier to be forcibly adhered to the photoreceptor;

applying an electric field corresponding to a collecting bias to the carrier adhering to the photoreceptor to collect the carrier by a force of the electric field;

measuring the amount of carriers remaining on the photoreceptor and setting the collecting bias in the image forming mode on the basis of the amount of the carriers; and setting a developing bias voltage of the developer in the carrier adhesion detecting mode to a different value than in the image forming mode.

10. The non-transitory recording medium storing a computer readable control program according to claim 9, wherein, in the setting of the collecting bias, the amount of carriers remaining on the photoreceptor when the collecting bias is set to each of a plurality of different values is measured, and the collecting bias is set on the basis of a relationship between the collecting bias and the amount of carriers remaining on the photoreceptor for the each of the different values of the collecting bias.

11. The non-transitory recording medium storing a computer readable control program according to claim 10, wherein, in the setting of the collecting bias, the amount of carriers remaining on the photoreceptor is measured in each of cases where, around a predetermined reference bias serving as a reference for carrier collection, a direct current component of the collecting bias is set to a first and a second collecting biases which have a voltage higher than that of the predetermined reference bias and have different magnitudes from each other and at a third and a fourth collecting biases which have a voltage lower than that of the reference bias and have different magnitudes from each other, and the collecting bias is set to a collecting bias with which the amount of carriers remaining on the photoreceptor becomes the smallest on the basis of a relationship between the first to the fourth collecting biases and the amount of carriers remaining on the photoreceptor.

12. The non-transitory recording medium storing a computer readable control program according to claim 9, wherein, in the setting of the collecting bias, the amount of carriers remaining on the photoreceptor when a value of a condition related to the collecting bias is varied is measured, and a collecting bias with which the amount of carriers remaining on the photoreceptor becomes the smallest is set to the collecting bias.

13. The non-transitory recording medium storing a computer readable control program according to claim 12, wherein the image forming apparatus further comprises: an adhesive roller that abuts against the photoreceptor during execution of the carrier adhesion mode and rotates in accordance with the rotation of the photoreceptor to adsorb a carrier on the photoreceptor; and a detection sensor that detects the carrier adhering to the adhesive roller, in the setting of the collecting bias, a cumulative amount of carriers adhering to the adhesive roller in a cumulative manner when a value of a condition related to the collecting bias is continuously varied is measured, and the collecting bias is set to a collecting bias with which the amount of change in the cumulative amount of carriers before and after varying the value of the condition is the minimum.

14. The non-transitory recording medium storing a computer readable control program according to claim 9, wherein the switching of the operation mode to the carrier adhesion detecting mode is executed at the time of replacing the photoreceptor, at the time of replacing the two-component developing agent, or at the time of executing the image stabilizing mode.

* * * * *